US006339211B1

(12) United States Patent
Foote et al.

(10) Patent No.: US 6,339,211 B1
(45) Date of Patent: Jan. 15, 2002

(54) REDUCING A TEMPERATURE DIFFERENTIAL IN A FIXING DEVICE

(75) Inventors: Wayne E Foote, Eagle; David J Arcaro, Boise; Kenneth E Heath, Boise; B. Mark Hirst, Boise; Mark Wibbels, Boise, all of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/611,803

(22) Filed: Jul. 7, 2000

(51) Int. Cl.[7] ..... H05B 1/00

(52) U.S. Cl. ..... 219/216; 399/328; 399/330; 399/69; 219/469; 118/60; 430/350; 347/154

(58) Field of Search ..... 399/330–335, 399/328–338, 285–286, 69; 219/216, 469–471; 118/60; 430/350, 353; 347/154

(56) References Cited

U.S. PATENT DOCUMENTS 4,064,933 A * 12/1977 Schuman ..... 165/89
4,512,650 A * 4/1985 Kocher ..... 355/3 FU
5,278,618 A * 1/1994 Mitani et al. ..... 355/285
RE35,923 E * 10/1998 Mitsuya ..... 399/330
6,006,052 A * 12/1999 Kamimura et al. ..... 399/69
6,026,273 A * 2/2000 Kinouchi et al. ..... 399/328

* cited by examiner

*Primary Examiner*—Tu Ba Hoang
*Assistant Examiner*—Shawntina T. Fuqua
(74) *Attorney, Agent, or Firm*—Gregg W. Wisdom

(57) ABSTRACT

A temperature differential over a length of a fuser can result from a thermal load applied to the fuser by media having a dimension, corresponding to a longitudinal axis of the fuser, less then the length of the fuser. The temperature on regions of the surface of the fuser contacting the media is lower than on regions of the surface not contacting the media. With feedback used to control the fuser surface temperature near its center, the fuser surface temperature in regions not contacting the media can become hot enough to damage the fuser. With a heat pipe included in the fuser, heat flows from the higher temperature regions on the surface of the fuser to the lower temperature regions on the surface of the fuser, thereby reducing the peak magnitude of the fuser surface temperature and the magnitude of the temperature differential over the length of the fuser.

12 Claims, 5 Drawing Sheets

REDUCING A TEMPERATURE DIFFERENTIAL IN A FIXING DEVICE

FIELD OF THE INVENTION

This invention relates to a fixing device. More particularly, this invention relates to equalizing the temperature across the fixing device.

BACKGROUND OF THE INVENTION

In imaging devices, such as electrophotographic printers or copiers, images are formed on media using particles of a pigmented material, such as toner. The toner is bonded to the surface of the media through the application of heat and pressure using a heating device, such as a fixing device. A thermal load is applied to the fixing device from contact with the media during fixing. The temperature on the surface of the fixing device drops in regions contacting the thermal load. If the thermal load is not uniform across the surface of the fixing device, a non-uniform temperature distribution will result. For example, passing narrow width media (such as envelopes, postcards, or even letter size media when used in an electrophotographic imaging device capable forming images on larger sizes of media) through the fixing device will lower the temperature (relative to the temperature before contact with the media) on the surface of the fixing device in areas that contact the media, while areas on the surface of the fixing device outside the width of the media will have a higher temperature (relative to the temperature before contact with the media).

Typically, the temperature on the surface of the fixing device within the media path is controlled using negative feedback. In response to an application of the thermal load, the power supplied to the fixing device is increased in an attempt to offset the drop in temperature resulting from application of the thermal load. However, those areas on the surface of the fixing device not in contact with the media can increase in temperature (depending upon the location of a temperature sensor used in the feedback) because of the increase in power supplied to the fixing device. The high temperatures that result may be sufficient to damage the fixing device. A need exists for a heating device that can achieve improved temperature equalization across its surface.

SUMMARY OF THE INVENTION

Accordingly, a method has been developed to reduce a temperature differential on a heating device. In an imaging device, the method for reducing the temperature differential on a heating device, includes supplying power to the heating device to generate heat. The method further includes contacting the heating device with media. In addition, the method includes transferring the heat through a heat pipe to reduce a magnitude of the temperature differential.

A heating device for providing heat to media in an imaging device, includes a heat pipe. In addition, the heating device includes a heating element arranged to provide heat to the media. The heat pipe includes an arrangement to provide heat to a first region of the heating element thermally loaded by the media and includes an arrangement to receive heat from a second region of the heating element thermally unloaded by the media. Furthermore, the heating device includes a support member arranged to provide mechanical support to the heat pipe and the heating element.

A fixing device includes a heat pipe and a support member arranged to provide mechanical support to the heat pipe. In addition, the fixing device includes a heating element and a reflector configured to reflect heat from the heating element. Furthermore, the fixing device includes a film contacting the heat pipe and surrounding the heat pipe and the support member. The reflector includes a position to reflect the heat from the heating element onto the film.

A fixing device includes a heat pipe and a heating element. The heat pipe also includes an arrangement to transfer heat from the heating element into the heat pipe and to transfer the heat from the heat pipe into the heating element. The heat pipe further includes a support member arranged to provide mechanical support to the heat pipe and the heating element. In addition, the heat pipe includes a film surrounding the heat pipe, the heating element, and the support member.

DESCRIPTION OF THE DRAWINGS

A more thorough understanding of embodiments of the heating device may be had from the consideration of the following detailed description taken in conjunction with the accompanying drawings in which:

Shown in FIG. 1 is a simplified cross sectional view of an embodiment of an imaging device including an embodiment of the fixing device.

Figure 2:
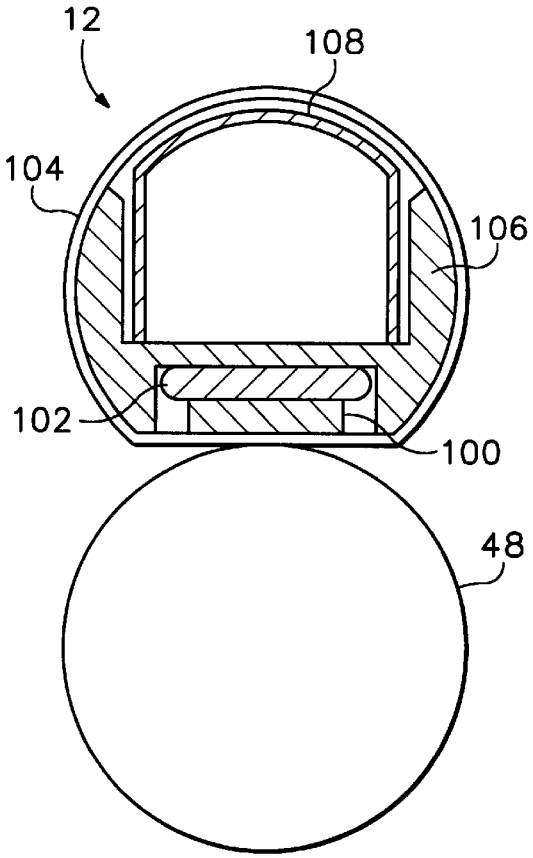

Shown in FIG. 2 is a simplified drawing of an embodiment of the fixing device.

Shown in FIG. 3 is a simplified drawing of an embodiment of the fixing device used in a test configuration for measuring the effect of using a heat pipe.

Shown in FIGS. 4A–4G are alternative embodiments of the fixing device.

Figure 5:
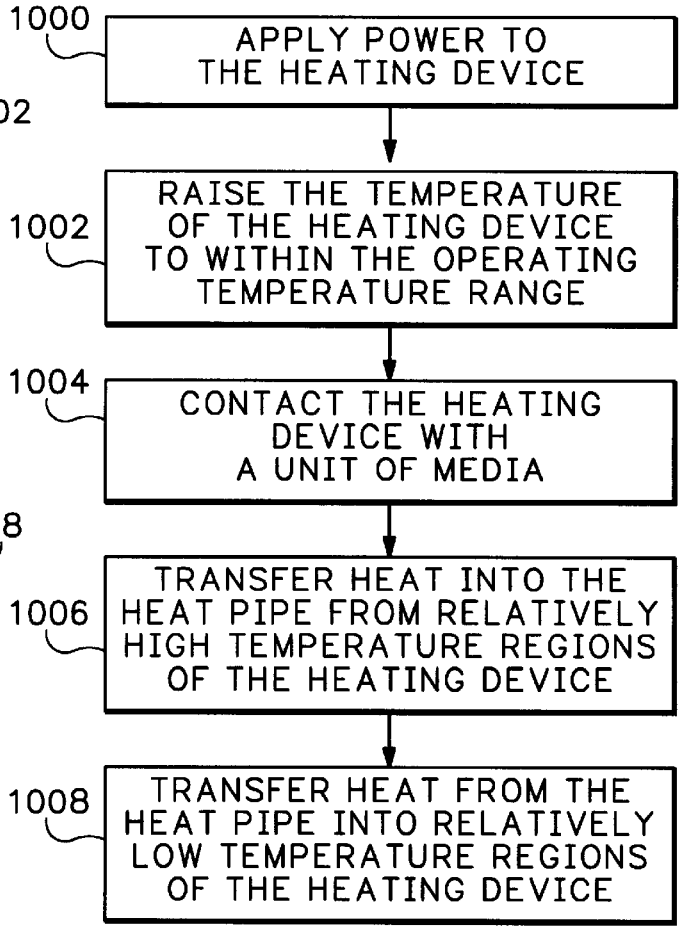

Shown in FIG. 5 is a high level flow diagram of a method for using the heating device.

DETAILED DESCRIPTION OF THE DRAWINGS

The heating device is not limited to the exemplary embodiments disclosed in this specification. Furthermore, although the embodiments of the heating device, such as a fixing device, will be discussed in the context of an imaging device, such as an electrophotographic printer, it should be recognized that embodiments of the heating device can be beneficially used in other electrophotographic imaging devices such as electrophotographic copiers, facsimile machines and the like. In addition, embodiments of the heating device could be adapted for use in imaging devices, such as inkjet printers, that utilize heaters to dry ink applied to media.

The latest generation of electrophotographic imaging devices have, as a design objective, high power efficiency and a short time period between initiating the print job and completing the imaging operation on the first unit of the media. The performance of the fixing device can significantly influence both of these performance attributes. To assist in achieving this objective, a cylindrical member having a low thermal mass, such as a cylinder of a film (made of, for example, a polyimide material), is used as the outer layer of the fixing device. A low thermal mass allows a rapid increase in temperature of the fixing device from the idle condition. Heat for fixing toner to the media is supplied by a heating element through the film to the media. The heating element supplies substantially constant power over the length of the heating element.

When a thermal load, such as a unit of the media, contacts the film, heat is conducted from the film into the media and the temperature of the film is initially lowered. However, fixing devices generally have a temperature sensor used in a feedback loop that attempts to maintain the temperature on the surface of the film substantially equal to an operating temperature over the length of the fixing device during the fixing process. In response to the application of the thermal load, the power supplied to the fixing device is increased to offset the temperature drop. How the temperature of the fixing device responds to thermal loading by media depends, in part, on the size of the dimension of the media corresponding to the length of the fixing device and the position of the temperature sensor on the fixing device.

Consider a fixing device with the temperature sensor located along the length of the fixing device so that the narrowest type of media used will cover a region of the film that also contacts the temperature sensor. If the media is sufficiently wide, the feedback will maintain the surface temperature of the film at the operating temperature over the length of most of the fixing device. However, if media that is narrow with respect to the length of the fixing device contacts the fixing device, the temperature of the film in regions contacted by the media will initially drop because of the thermal load and then the feedback will operate to increase the power supplied over the length of the fixing device to set the temperature of the film in the region near the temperature sensor substantially equal to the operating temperature. Regions on the surface of the film outside of the region covered by the media will experience temperatures above the operating temperature. It is possible that the temperature of these regions may rise sufficiently to damage the polyimide layer.

Consider a fixing device with the temperature sensor located along the length of the fixing device so that the most commonly used type of media covers a region of the film that contacts the temperature sensor, while more narrow types of media used will not cover this region. If the media thermally loading the fixing device is sufficiently wide, the feedback will maintain the surface temperature of the film substantially equal to the operating temperature over the length of most of the fixing device. However, for media that is sufficiently narrow so that it does not cover regions of the film contacting the temperature sensor, the surface of the film not covered with the media will be substantially equal to the operating temperature, while the surface of the film covered by the media may be substantially below the operating temperature of the fixing device. If the temperature of the region covered by the media is sufficiently low, toner will not be adequately fixed to the media.

The film has lower thermal mass than the roller used in other implementations of the fixing device. This allows the surface temperature of the film to rapidly change from the temperature during the idle condition of the fixing device to the operating temperature of the fixing device. However, the lower thermal mass of the film also causes a higher magnitude change in surface temperature when thermally loaded because relatively little heat is stored within it. This results in, depending upon the location of the temperature sensor, either more damage to the film or lower quality fixing of the toner to the media.

To reduce the magnitude of the temperature differential over the surface of the film, the embodiments of the fixing device disclosed in this specification include embodiments of a heat pipe. The heat pipe distributes heat from the high temperature regions of the fixing device to the low temperature regions of the fixing device sufficiently rapidly to either reduce the likelihood of damage to the film or to improve the quality of the fixing of the toner to the media.

Figure 1:
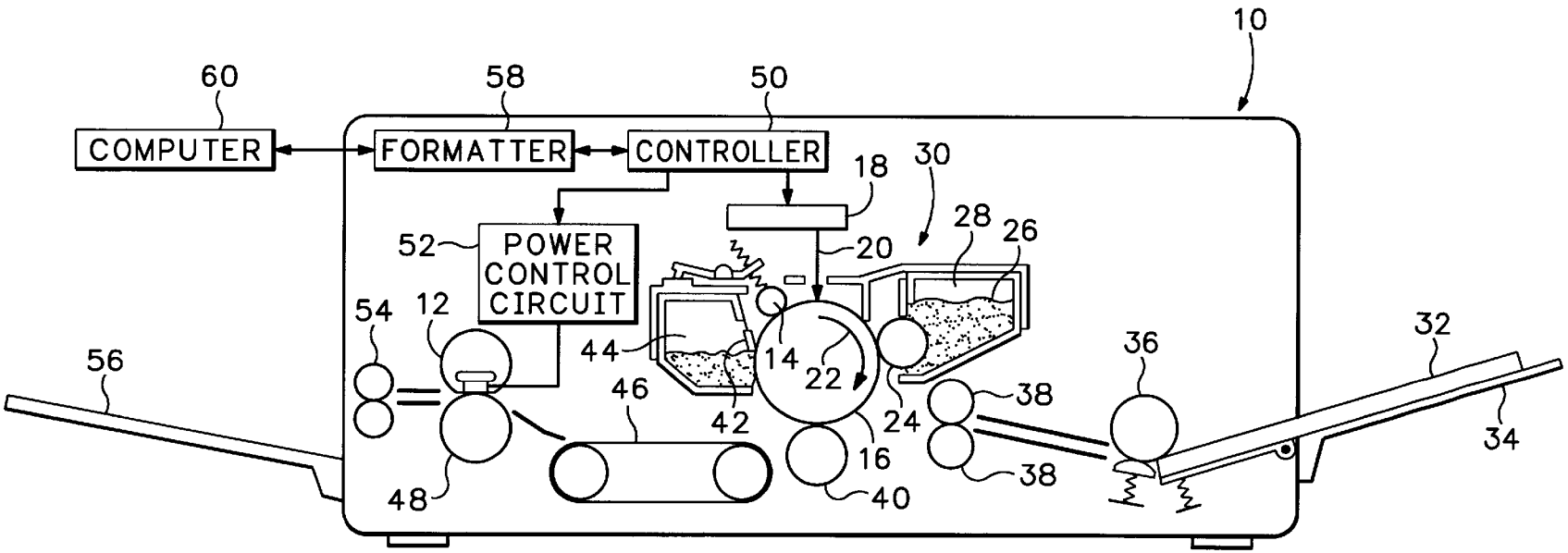

Shown in FIG. 1 is a simplified cross sectional view of an embodiment of an electrophotographic imaging device, such as electrophotographic printer 10, including an embodiment of a fixing device, such as fuser 12. A charging device, such as charge roller 14, is used to charge the surface of a photoconductor, such as photoconductor drum 16, to a predetermined voltage. A laser diode (not shown) inside laser scanner 18 emits a laser beam 20 which is pulsed on and off as it is swept across the surface of photoconductor drum 16 to selectively discharge the surface of the photoconductor drum 16. Photoconductor drum 16 rotates in the clockwise direction as shown by the arrow 22. A developing device, such as developing roller 24, is used to develop the latent electrostatic image residing on the surface of photoconductor drum 16 after the surface voltage of the photoconductor drum 16 has been selectively discharged. Toner 26, which is stored in the toner reservoir 28 of electrophotographic print cartridge 30, moves from locations within the toner reservoir 28 to the developing roller 24. A magnet located within the developing roller 24 magnetically attracts toner 26 to the surface of the developing roller 24. As the developing roller 24 rotates in the counterclockwise direction, the toner 26, located on the surface of the developing roller 24 opposite the areas on the surface of photoconductor drum 16 which are discharged, can be moved across the gap between the surface of the photoconductor drum 16 and the surface of the developing roller 24 to develop the latent electrostatic image.

Media, such as print media 32, is loaded from paper tray 34 by pickup roller 36 into the media path of the electrophotographic printer 10. Print media 32 is moved along the media path by drive rollers 38. As the photoconductor drum 16 continues to rotate in the clockwise direction, the surface of the photoconductor drum 16, having toner adhered to it in the discharged areas, contacts the print media 32 which has been charged by a transfer device, such as transfer roller 40, so that it attracts particles of toner 26 away from the surface of the photoconductor drum 16 and onto the surface of the print media 32. The transfer of particles of toner 26 from the surface of photoconductor drum 16 to the surface of the print media 32 is not fully efficient and therefore some toner particles remain on the surface of photoconductor drum 16. As photoconductor drum 16 continues to rotate, toner particles, which remain adhered to its surface, are removed by cleaning blade 42 and deposited in toner waste hopper 44.

As the print media 32 moves in the media path past photoconductor drum 16, conveyer 46 delivers the print media 32 to fuser 12. Fuser 12 includes an embodiment of a heat pipe. Print media 32 passes between pressure roller 48 and fuser 12. Pressure roller 48 is coupled to a gear train (not shown in FIG. 1) in electrophotographic printer 10. Print media 32 passing between pressure roller 48 and fuser 12 is forced against fuser 12 by pressure roller 48. As pressure roller 48 rotates, print media 32 is pulled between fuser 12 and pressure roller 48. Heat applied to print media 32 by fuser 12 fixes toner 26 to the surface of print media 32.

Controller 50 is coupled to an embodiment of a power control circuit, power control circuit 52. Power control circuit 52 controls the electric power supplied to a heating element included in fuser 12, thereby controlling the operating temperature of the fixing device. Power control circuit 52 controls the average electrical power supplied to fuser 12 by adjusting the number of cycles of the line voltage per unit time applied to fuser 12. After exiting fuser 12, output rollers 54 push the print media 32 into the output tray 56.

Electrophotographic printer 10, includes formatter 58. Formatter 58 receives print data, such as a display list, vector graphics, or raster print data, from the print driver operating in conjunction with an application program in computer 60.

Formatter 58 converts this relatively high level print data into a stream of binary print data. Formatter 58 sends the stream of binary print data to controller 50. In addition, formatter 58 and controller 50 exchange data necessary for controlling the electrophotographic printing process. Controller 50 supplies the stream of binary print data to laser scanner 18. The binary print data stream sent to the laser diode in laser scanner 18 is used to pulse the laser diode to create the latent electrostatic image on photoconductor drum 16.

In addition to providing the binary print data stream to laser scanner 18, controller 50 controls a high voltage power supply (not shown in FIG. 1) to supply voltages and currents to components used in the electrophotographic processes such as charge roller 14, developing roller 24, and transfer roller 40. Furthermore, controller 50 controls a drive motor (not shown in FIG. 1) that provides power to the printer gear train and controller 50 controls the various clutches and paper feed rollers necessary to move print media 32 through the media path of electrophotographic printer 10.

Shown in FIG. 2 is a cross sectional view of a first embodiment of fuser 12. Heating element 100 generates heat from the electrical power supplied by power control circuit 52. An embodiment of a heat pipe, heat pipe 102 is configured to receive heat from heating element 100. Heat pipe 102 distributes heat over the length of heating element 100 to reduce the temperature differentials resulting from the varying thermal load across the length of heating element 100. Film 104 surrounds heating element 100 and heat pipe 102. Heat is transferred through film 104 for fixing toner 26 onto print media 32. A first support member, such as frame 106 is included in fuser 12 to provide support to maintain the shape of film 104. A second support member, such as stiffener 108, contacts frame 106. Stiffener 108 provides mechanical support for frame 106 so that fuser 12 is sufficiently rigid to mechanically load fuser 12 against pressure roller 48. Heating element 100 and heat pipe 102 are recessed in a channel formed in frame 106. It should be recognized that although mechanical support is provided to fuser 12 using frame 106 and stiffener 108, the functions of these parts could be combined into a single member, such as an embodiment of a support member. In this implementation of fuser 12, frame 106 is formed from a plastic material and stiffener 108 is formed from metal. However, in an implementation in which the functions of these parts were combined into a support member, a variety of materials could be used, such as plastic, metal, ceramic, or some combination of these materials.

Heat pipe 102 performs the function of distributing the heat provided by heating element 100 to reduce the temperature differential that would otherwise develop over the length of fuser 12 from thermal loading of fuser 12 by print media 32. As previously mentioned, the locations of these temperature differentials over the length of fuser 12 will depend upon a dimension of print media 32 parallel to a longitudinal axis of fuser 12. Heat pipe 102 contacts heating element 100 over its length.

Through the contact between heat pipe 102 and heating element 100, heat is transferred between heating element 100 and heat pipe 102. To improve the thermal conductivity between heat pipe 102 and heating element 100, a thermally conductive material, such as a thermal compound, can be positioned between heat pipe 102 and heating element 100. The thermal compound performs the function of filling air gaps between the surfaces at the interface of heating element 100 and heat pipe 102, thereby increasing the thermal conductivity between heating element 100 and heat pipe 102. However, it is possible that the thermal conductivity between heating element 100 and heat pipe 102 is sufficient to not require the use of a thermal compound. This is possible if, for example, a relatively high percentage of the available surface areas at the interface between heating element 100 and heat pipe 102 are in contact without using gap filling material.

An embodiment of heat pipe 102 includes a copper tube having a generally rectangular cross section. During construction, air is substantially evacuated from the volume inside the tube and a small amount of a working fluid, such as water is added to the volume inside of the tube. Sufficient water is added so that over the operating temperature range of heat pipe 102 water in liquid form can be present. The tube is sealed to trap the water within. The phase change of water between the liquid phase and the vapor phase assists in the transfer of heat in heat pipe 102.

Heat pipe 102 acts to reduce the temperature differential through a heat transfer loop. Consider a print job including multiple relatively narrow units of print media 32 with the temperature sensor located near the center of fuser 12. As units of print media 32 pass between fuser 12 and pressure roller 48, the thermal load causes an increase in the power supplied to heating element 100 to set the temperature on the surface of fuser 12 in regions contacting print media 32 at a temperature substantially equal to the operating temperature. Regions on the surface of fuser 12 not contacting print media 32 rise above the operating temperature of fuser 12 as do the corresponding regions on heating element 100.

Heat from heating element 100 is conducted into heat pipe 102 when power is supplied to the heating element. The water inside of heat pipe 102 evaporates as heat is conducted into heat pipe 102. The pressure that develops in heat pipe 102 from the evaporated water quickly establishes an equilibrium condition between the liquid water and the water vapor.

The relatively hot regions of heat pipe 102 (corresponding to relatively hot regions of heating element 100 and regions fuser 12 not contacted by print media 32) vaporize liquid water in these regions of heat pipe 102 because the temperatures of these regions are above the vaporization temperature of the water at the pressure inside of heat pipe 102. The vaporization removes heat from the relatively hot regions and lowers the temperature of these regions. The heat is stored in the vaporized water. The water vapor in heat pipe 102 near the relatively cool regions of heat pipe 102 (corresponding to relative cool regions of heating element 100 and regions of fuser 12 contacted by print media 32) condenses the water vapor in these regions of heat pipe 102 because the temperatures of these regions are below the vaporization temperature of the water at the pressure inside of heat pipe 102. The condensation transfers heat from the water vapor to the relatively cool regions and increases the temperature of these regions. The condensed water moves back from the relatively cool regions to the relatively hot regions through capillary action. Wire mesh or a grooved surface in the interior of heat pipe 102 are used to move the liquid water through capillary action. However, some embodiments of heat pipes can be constructed to return the liquid water to the relatively hot regions for vaporization without requiring an internal structure to transport the condensed water.

The regions of heat pipe 102 from which heat is removed draw heat from the corresponding regions of heating element 100, thereby decreasing the temperature of the corresponding regions on the surface of fuser 12. The regions of heat pipe 102 to which heat is added deliver heat to the corresponding regions of heating element 100, thereby increasing the temperature of the corresponding regions on the surface of fuser 12. In this manner, heat pipe 102 redistributes heat from relatively hot regions to relatively cool regions, thereby reducing the magnitude of the temperature differential over the length of fuser 12 and reducing the likelihood of heat damage to film 104 forming the surface of fuser 12. If heat pipe 102 were used in a fuser having a temperature sensor located near an end of the longitudinal axis of the fixing device, then heat pipe 102 would redistribute heat along the length of the fuser to maintain temperatures for adequate fixing over most of the length of the fuser.

Before the beginning of the imaging operation, no power is supplied to fuser 12. The low thermal mass of fuser 12 permits the operating temperature of fuser 12 to be rapidly reached from the temperature of fuser 12 with no power applied. It should be recognized that a heat pipe could be beneficially used in a fuser that, when idle, is maintained at a standby temperature to permit the operating temperature of the fuser to be rapidly reached. Shortly after the beginning of the imaging operation, power control circuit 52 applies power supplied to fuser 12 to increase its temperature to the operating temperature. After power control circuit 52 applies power supplied to fuser 12, heat pipe 102 performs the heat transfer function sufficiently rapidly to control the temperature differential over the length of fuser 12 to reduce the likelihood of film 104 reaching damaging temperatures during the warm up period of fuser 12 as well as during equilibrium.

It should be recognized that a wide variety of heat pipe implementations may be used for heat pipe 102. The tube included in heat pipe 102 may be constructed of materials other than copper. For example, the material forming the tube in heat pipe 102 may include stainless steel, nickel, aluminum, or ceramic. In addition, a variety of working fluids may be used as a heat transfer medium. For example, the liquid used as the working fluid may include nitrogen, ammonia, or methanol. Examples of a class of heat pipes that could be used for heat pipe 102 are the THERM-A-PIPE heat pipes supplied by Indek Corporation. The performance attribute of a heat pipe making it useful in a fixing device is its ability to move heat from relatively high temperature regions in the heat pipe to relatively low temperature regions.

Figure 3A:
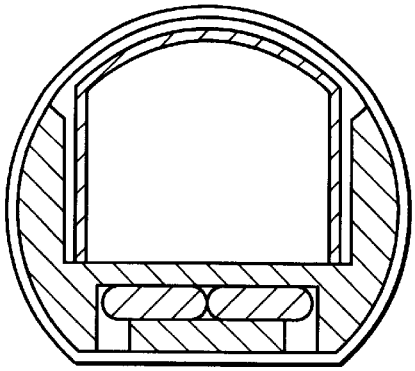
Figure 3B:
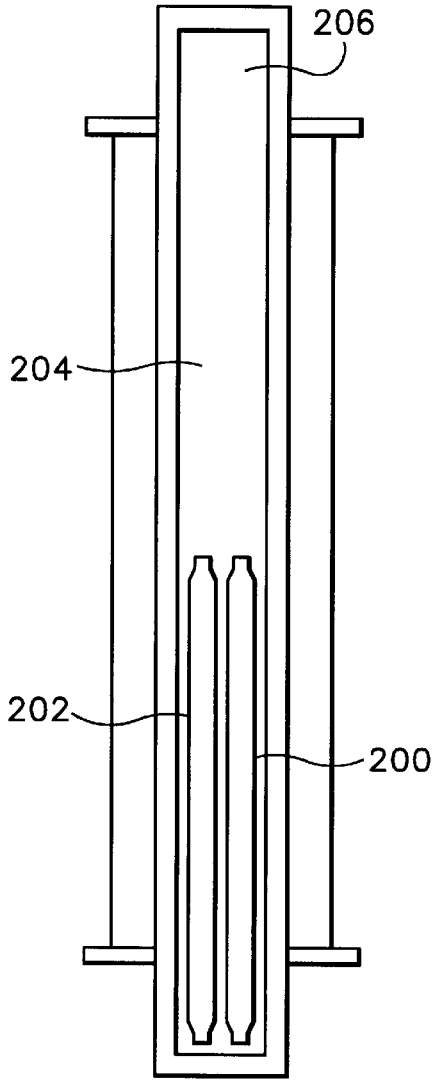

Shown in FIGS. 3A and 3B is a simplified representation of a test configuration, using two Indek Corporation heat pipes (model number H-331-150), demonstrating the temperature equalization characteristics of a heat pipe in a fuser. In this configuration, two standard Indek heat pipes were used instead of a single standard Indek heat pipe of equivalent size to reduce the thermal mass contributed by the heat pipe to the fuser. However, it should be recognized that a single heat pipe designed to have the desired thermal mass could be used. The test configuration used a fuser modified to accommodate the heat pipes so that approximately one half of the length of the resistive heating element in the fuser was in close contact with the two heat pipes. This configuration was selected to show the temperature gradient on the fuser with and without the use of heat pipes.

The fuser was operated in a laser printer with media having a width, in the dimension corresponding to the longitudinal axis of the fuser, of approximately 4.25 inches. The media moved through the media path of the laser printer so that the center of the media was positioned very close to the center of the longitudinal axis of the fuser. Using a thermal video camera, the temperature profile on the surface of the fuser was measured very shortly after 10 units of the media were passed through the laser printer. Location 200 corresponds to a position on the side of the fuser with the heat pipes and outside of the contact area of the media on the fuser. Location 202 corresponds to a position on the side of the fuser with the heat pipes and within the contact area of the media on the fuser. Location 204 corresponds to a position on the side of the fuser without the heat pipes and within the contact area of the media on the fuser Location 206 corresponds to a position on the side of the fuser without the heat pipes and outside of the contact area of the media on the fuser. The measurement results at these locations are as follows:

| | |
|---|---|
| location 200 | 137.14 C. |
| location 202 | 122.14 C. |
| location 204 | 100.39 C. |
| location 206 | 158.49 C. |

As can be seen from the temperature measurement data, the use of heat pipes reduces the temperature differential. The temperature differential between the locations inside and outside the contact area of the media on the side of the fuser with the heat pipes is 15 degrees centigrade. However, the temperature differential between the locations inside and outside the contact areas of the media on the side of the fuser without the heat pipes is approximately 58 degrees centigrade. Furthermore, the temperature difference between the regions outside the contact areas of the media for the side with the fuser and the side without the fuser is approximately 20 degrees centigrade. Therefore, the heat pipes are effective in reducing the temperature differential across the fuser and reducing the maximum temperature to which the fuser is subjected.

Although an embodiment of the fixing device has been discussed in the context of a fuser having a resistive heating element on the surface of a ceramic substrate, it should be recognized that a heat pipe may be used to reduce temperature differentials in embodiments of fixing devices using halogen bulb heating elements, inductive heating elements, or other types of heating elements. Furthermore, although an embodiment of the fixing device has been discussed in the context of a fuser having a heating element located internal to the surface through which heat is delivered to the media, it should be recognized that a heat pipe may be used to reduce temperature differentials in embodiments of fixing devices having a heating element located external to the surface through which heat is delivered to the media. For example, an embodiment of a fixing device could be constructed using a heater and a reflector external to a surface with an embodiment of a heat pipe in contact with the surface to reduce temperature differentials over the surface.

Figure 4A:
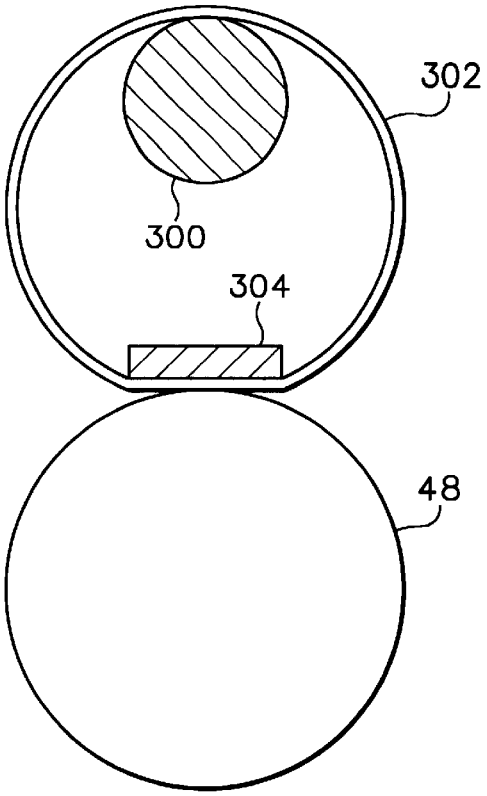
Figure 4B:
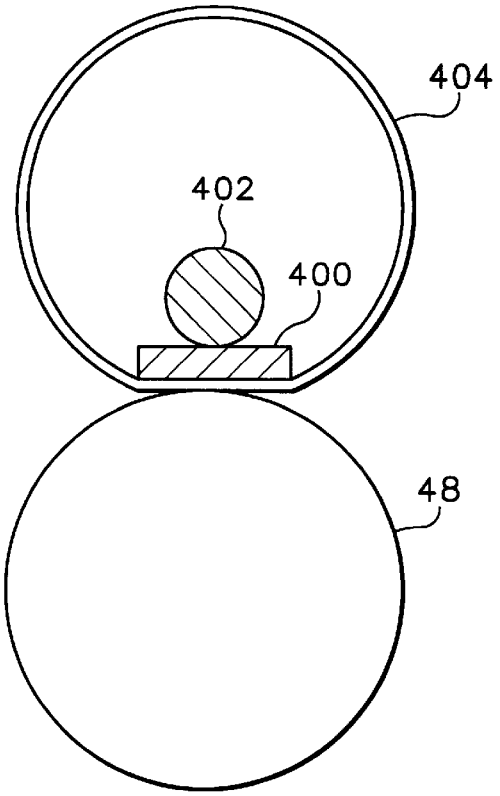

Shown in FIGS. 4A through 4F are simplified cross sectional views of alternative embodiments of a fixing device to illustrate only a small number of the possible configurations for placement of the heating element relative to the heat pipe. In FIG. 4A, heat pipe 300 is located to contact film 302 opposite heating element 304. As regions of film 302 rotate over heat pipe 300, the temperature differential of regions on film 302 contacting heat pipe 300 are reduced. In FIG. 4B, heat pipe 400 is positioned between heating element 402 and film 404. Heat generated by heating element 402 flows through heat pipe 400 into film 404. The temperature differential across film 404 caused by a non-uniform thermal load causes more heat flow through regions of heat pipe 400 contacting the regions of film 404 having a relatively higher thermal load.

Figure 4C:
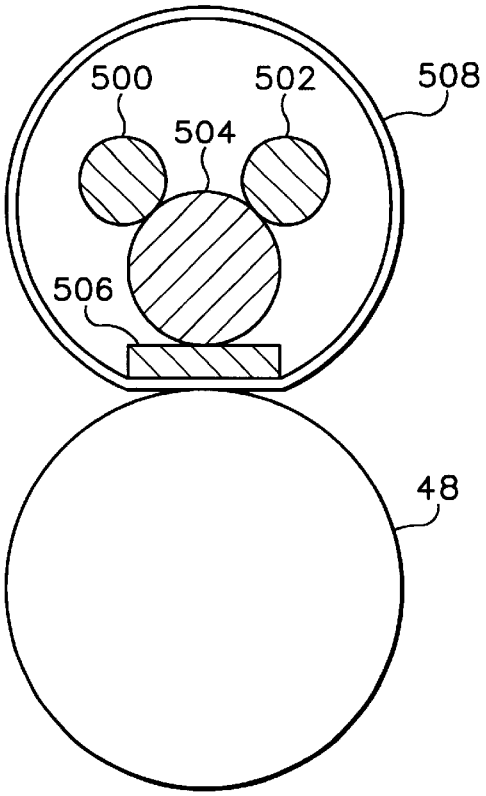
Figure 4D:
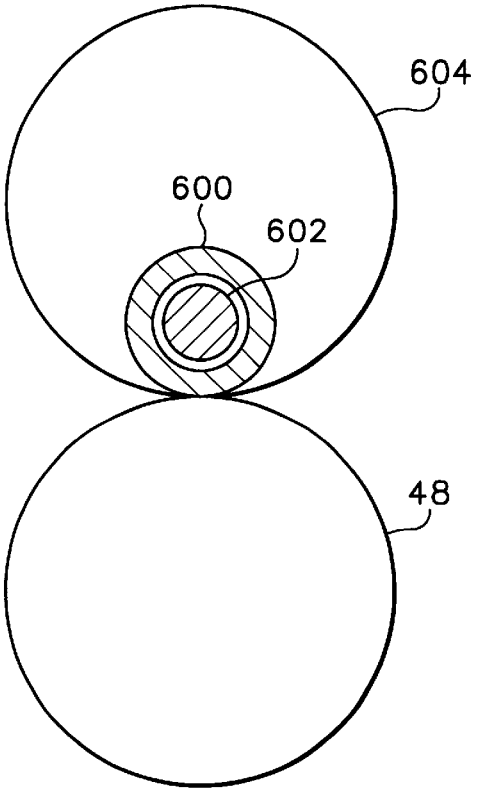
Figure 4E:
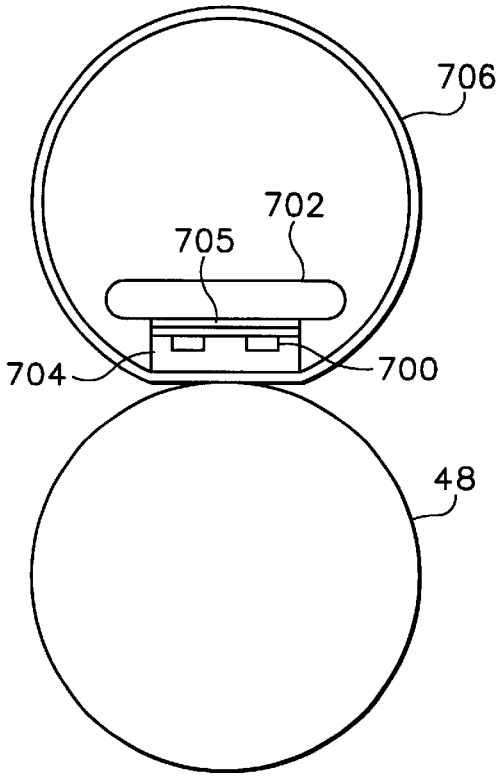
Figure 4F:
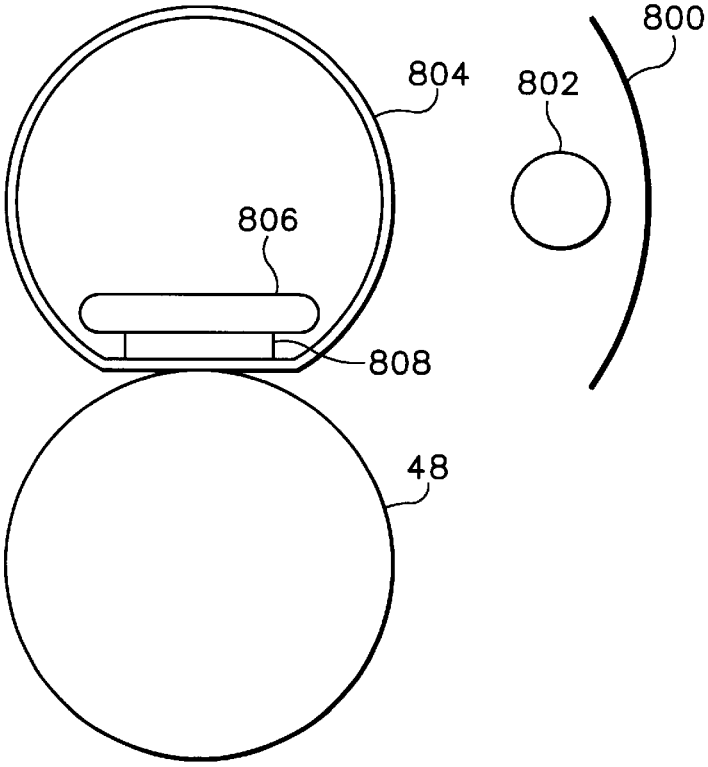
Figure 4G:
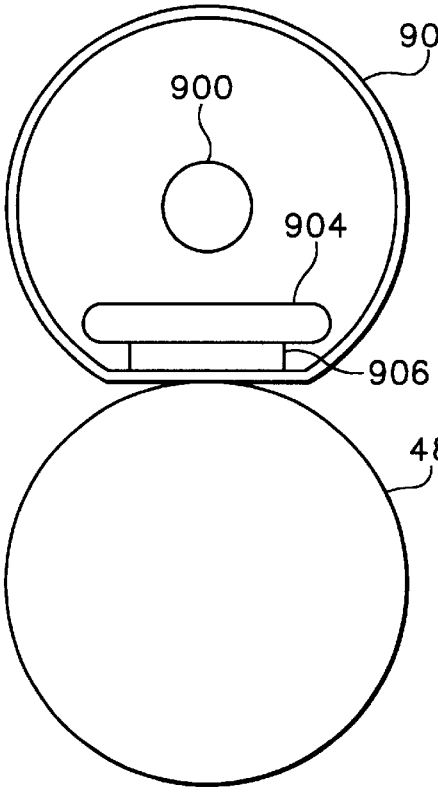

In FIG. 4C, two heating elements 500, 502 contact heat pipe 504. Heat flows from heating elements 500, 502 through heat pipe 504 and pressure plate 506 into film 508. In FIG. 4D, heat pipe 600 includes a cylinder having an annular cross section. Heating element 602 is located concentrically inside of heat pipe 600. Heat flows from heating element 602 through heat pipe 600 into film 604. In FIG. 4E, heating element 700 is positioned between heat pipe 702 and pressure plate 704. A thermally conductive material, such as thermal compound 705 fills gaps that may otherwise be present at the interface between heat pipe 702 and heating element 700 to help transfer heat between them. Heat is conducted through pressure plate 704 into film 706. In FIG. 4F, reflector 800 reflects heat generated by heating element 802 onto film 804. Heat pipe 806 distributes heat along the length of the fixing device to reduce the magnitude of the temperature differential resulting from contact with media. Pressure plate 808 permits loading of pressure roller 48 against film 804. In FIG. 4G, heating element 900 radiates heat onto film 902. Heat pipe 904 distributes heat over film 902 to reduce the magnitude of the temperature differential resulting from contact with the media. Pressure plate 906 permits loading of pressure roller 48 against film 902.

Shown in FIG. 5 is a high level flow diagram of a method of using a heating device to reduce the temperature differential across the heating device. First, in step 1000, power is applied to the heating device. Then, in step 1002, the temperature of the heating device reaches a value within an operating temperature range suitable for the application of the heating device (for example for fixing toner to media or for drying ink on media). Next, in step 1004, a unit of media contacts the heating device, thereby applying a thermal load to the heating device and creating a temperature differential across the heating device. Then, in step 1006, heat flows into a heat pipe from regions of the heating device having a relatively high temperature, thereby lowering the temperature of these regions. Finally, in step 1008, heat flows from the heat pipe into regions of the heating device having a relatively low temperature, thereby raising the temperature of these regions.

Although several embodiments of heating devices have been illustrated, and their forms described, it is readily apparent to those of ordinary skill in the art that various modifications may be made to these embodiments without departing from the spirit of the invention or from the scope of the appended claims.

What is claimed is:

1. A heating device for providing heat to media in an imaging device, comprising:

a heat pipe;

a heating element arranged to provide heat to the media, with the heat pipe arranged to provide heat to a first region of the heating element thermally loaded by the media and arranged to receive heat from a second region of the heating element thermally unloaded by the media and with the heating element contacting a substantial portion of a length of the heat pipe; and a support member arranged to provide mechanical support to the heat pipe and the heating element.

2. The heating device as recited in claim 1, further comprising:

a film surrounding the heat pipe, the support member, and the heating element with the film for contacting the media.

3. The heating device as recited in claim 2, wherein:

the heat pipe provides heat to the media through the film with the heating element positioned between the support member and the heat pipe.

4. The heating device as recited in claim 2, wherein:

the heating element provides heat to the media through the film with the heat pipe positioned between the support member and the heating element.

5. The heating device as recited in claim 4, further comprising:

an imaging device including the heating device.

6. The heating device as recited in claim 5, further comprising:

a fixing device including the heating device, with the fixing device configured to fix toner to the media and with the imaging device including an electrophotographic printer.

7. A fixing device comprising:

a heat pipe;

a heating element, with the heat pipe arranged to transfer heat from the heating element into the heat pipe and to transfer the heat from the heat pipe into the heating element and with the heating element contacting a substantial portion of a length of the heat pipe;

a support member arranged to provide mechanical support to the heat pipe and the heating element; and a film surrounding the heat pipe, the heating element, and the support member.

8. The fixing device as recited in claim 7, wherein:

the heat pipe contacts the film, with the heating element positioned between the heat pipe and the support member.

9. The fixing device as recited in claim 7, wherein:

the heating element contacts the film, with the heat pipe positioned between the heating element and the support member.

10. The fixing device as recited in claim 9, wherein:

the heating element includes a rectangularly shaped cross section; and the heat pipe includes a rectangularly shaped cross section.

11. The fixing device as recited in claim 10, wherein:

the heat pipe includes water.

12. A heating device for providing heat to media in an imaging device, comprising:

a heat pipe;

a heating element arranged to provide heat to the media, with the heat pipe arranged to provide heat to a first region of the heating element thermally loaded by the media and arranged to receive heat from a second region of the heating element thermally unloaded by the media;

a thermal compound positioned between the heat pipe and the heating element with the thermal compound contacting the heat pipe and contacting the heating element; and a support member arranged to provide mechanical support to the heat pipe and the heating element.

* * * * *